US011363360B2

(12) United States Patent
Little

(10) Patent No.: US 11,363,360 B2
(45) Date of Patent: Jun. 14, 2022

(54) ACOUSTIC REFLECTOR AND ACOUSTIC ELECTRONICS DEVICE

(71) Applicant: Goertek Inc., Shandong (CN)

(72) Inventor: Richard Warren Little, Shandong (CN)

(73) Assignee: Goertek Inc., Weifang (CN)

( * ) Notice: Subject to any disclaimer, the term of this patent is extended or adjusted under 35 U.S.C. 154(b) by 0 days.

(21) Appl. No.: 16/910,514

(22) Filed: Jun. 24, 2020

(65) Prior Publication Data

US 2020/0413176 A1 Dec. 31, 2020

Related U.S. Application Data

(60) Provisional application No. 62/866,777, filed on Jun. 26, 2019.

(51) Int. Cl.

| | |
|---|---|
| ***H04R 1/02*** | (2006.01) |
| ***H04R 9/02*** | (2006.01) |
| *H04R 1/34* | (2006.01) |

(52) U.S. Cl.

CPC ..... *H04R 1/028* (2013.01); *H04R 9/022* (2013.01); *H04R 1/345* (2013.01)

(58) Field of Classification Search

CPC ..... H04R 1/345; H04R 1/2826; H04R 1/20; H04R 1/2857; H04R 1/1016; H04R 1/1075; H04R 1/342; H04R 1/24; H04R 1/26; H04R 1/30; H04R 1/2865; H04R 1/021; H04R 1/2819; H04R 1/025; H04R 1/2842; H04R 1/02; H04R 1/225; H04R 1/2811; H04R 1/2834; H04R 1/08; H04R 1/222; H04R 1/2803; H04R 1/403; H04R 1/026; H04R 9/06; H04R 5/02; H04R 17/00; H04R 2499/15; H04R 2499/11; H04R 2499/10; H04S 1/002; H04N 5/642; G10K 11/025; H04M 1/035

USPC ..... 381/386, 388, 337–341, 345, 350–352, 381/160

See application file for complete search history.

(56) References Cited

U.S. PATENT DOCUMENTS

| | | | | | |
|---|---|---|---|---|---|
| 5,418,336 | A * | 5/1995 | Negishi | ..... | H04R 1/24 181/155 |
| 5,590,210 | A * | 12/1996 | Matsuo | ..... | H04R 9/025 29/594 |
| 2018/0288525 | A1* | 10/2018 | Katz | ..... | H04R 1/323 |

FOREIGN PATENT DOCUMENTS

| | | | | | |
|---|---|---|---|---|---|
| CN | 102685651 | A | | 9/2012 | |
| CN | 207340158 | U | | 5/2018 | |
| CN | 207340158 | U | * | 5/2018 | ..... H04R 1/20 |

* cited by examiner

*Primary Examiner* — Ahmad F. Matar
*Assistant Examiner* — Sabrina Diaz
(74) *Attorney, Agent, or Firm* — Baker Botts, LLP

(57) ABSTRACT

An acoustic reflector and an acoustic electronics device are disclosed. The acoustic reflector is for being used inside an enclosure of an acoustic electronics device, which is made of thermal conductive material and functions as a heat sink. The acoustic electronics device comprises such an acoustic reflector.

5 Claims, 3 Drawing Sheets

ACOUSTIC REFLECTOR AND ACOUSTIC ELECTRONICS DEVICE

CROSS-REFERENCE TO RELATED APPLICATION

This application claims priority to US Provisional Utility Patent Application No. 62/866,777, filed on Jun. 26, 2019, which is hereby incorporated by reference in its entirety.

FIELD OF THE INVENTION

The present invention relates to an acoustic device, and more specifically, to an acoustic reflector and an acoustic electronics device.

BACKGROUND OF THE INVENTION

An acoustic transducer of an acoustic device consumes power and generates heat. The acoustic transducer is, for example, a loudspeaker or a microphone.

In the prior art, some of the acoustic transducers are mounted inside enclosures of the acoustic devices. For example, such acoustic devices include Apple Home pod, Amazon Mini Dot, Google Home and so on.

In such acoustic devices, the heat generated therein will put an adverse impact on the performance of the device.

SUMMARY OF THE INVENTION

One object of this invention is to provide a new technical solution for acoustic reflector.

According to a first aspect of the present invention, there is provided an acoustic reflector for being used inside an enclosure of an acoustic electronics device, which is made of thermal conductive material and functions as a heat sink.

According to a second aspect of the present invention, there is provided an acoustic electronics device, comprising: an enclosure; an acoustic transducer, mounted inside the enclosure; a passage inside the enclosure; at least one sound port, wherein the passage connects the acoustic transducer to the at least one sound port; and an acoustic reflector according to claim 1, which is mounted in the passage and which reflects the sound wave from the acoustic transducer to the at least one sound port or from the at least one sound port to the acoustic transducer.

According to an embodiment of this invention, the present invention can improve thermal performance of an acoustic device without much change to its architecture design.

Further features of the present invention and advantages thereof will become apparent from the following detailed description of exemplary embodiments according to the present invention with reference to the attached drawings.

BRIEF DESCRIPTION OF THE DRAWINGS

The accompanying drawings, which are incorporated in and constitute a part of the specification, illustrate embodiments of the invention and, together with the description thereof, serve to explain the principles of the invention.

DETAILED DESCRIPTION OF THE EMBODIMENTS

Figure 1:
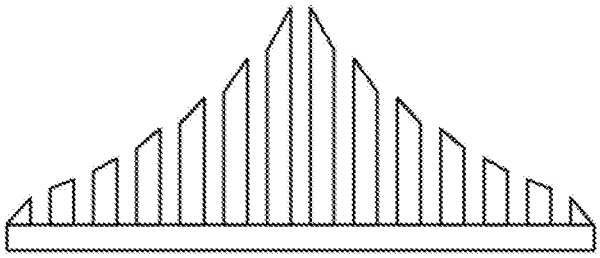
FIG. 1 is a schematic diagram of an acoustic reflector according to a first embodiment of this disclosure.

Various exemplary embodiments of the present invention will now be described in detail with reference to the drawings. It should be noted that the relative arrangement of the components and steps, the numerical expressions, and numerical values set forth in these embodiments do not limit the scope of the present invention unless it is specifically stated otherwise.

The following description of at least one exemplary embodiment is merely illustrative in nature and is in no way intended to limit the invention, its application, or uses.

Techniques, methods and device as known by one of ordinary skill in the relevant art may not be discussed in detail but are intended to be part of the specification where appropriate.

In all of the examples illustrated and discussed herein, any specific values should be interpreted to be illustrative only and non-limiting. Thus, other examples of the exemplary embodiments could have different values.

Notice that similar reference numerals and letters refer to similar items in the following figures, and thus once an item is defined in one figure, it is possible that it need not be further discussed for following figures.

In this disclosure, an acoustic reflector for being used inside an enclosure of an acoustic electronics device is provide. The acoustic reflector is made of thermal conductive material and functions as a heat sink.

For example, the thermal conductive material may include metal, such as copper and aluminium, and may further include aluminium nitride, and so on. Compared with adjacent component in the acoustic electronics device, the thermal conductive material has a better thermal conduction performance and can provide a thermal dispersion path to disperse the heat generated in the acoustic electronics device away.

An acoustic reflector can be used to adjust the frequencies and/or directions and/or volumes of sound generated by an acoustic electronics device in space so that the acoustic electronics device can provide a better acoustic performance. A conventional acoustic reflector did not take the thermal dispersion into consideration and compared with a heat sink, it did not use thermal conductive material and/or did not provide a thermal dispersion path.

Normally, in order to achieve an aesthetic feeling, an enclosure of an acoustic electronics device is designed to be an integrated shape. This is will limited the thermal dispersion inside the acoustic electronics device. Further, a separate heat sink will require an extra room inside the disclosure and extra vents for thermal dispersion.

Here, an acoustic reflector is combined with a heat sink. This is advantageous for being used inside an enclosure of an acoustic electronics device. The acoustic reflector will improve the sound travelling performance from/to the acoustic transducer and the heat sink will improve the heat dispersion inside the enclosure.

This design will save room for placing an extra heat sink and will leave more freedom of design to a designer.

Besides, because the sound wave will travel passing the acoustic reflector, which will also bring an air flow through the acoustic reflector, it will improve the thermal dispersion and omit the requirement of a fan to blow air through a heat sink.

Figure 2:
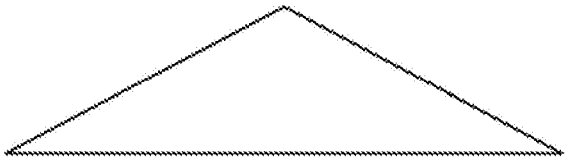
FIG. 2 is a schematic diagram of an acoustic reflector according to a second embodiment of this disclosure.
Figure 3:
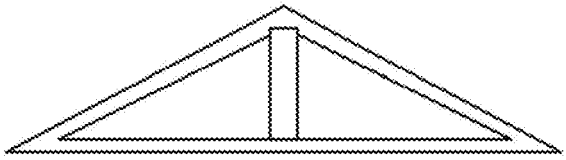
FIG. 3 is a schematic diagram of an acoustic reflector according to a third embodiment of this disclosure.

FIGS. 1-3 shows three embodiments of an acoustic reflector according to this invention.

In FIG. 1, the acoustic reflector is designed into a comb shape in cross-section view. The acoustic performance of an acoustic transducer can be adjusted by adjusting the comb teeth of the comb. The comb teeth and/or the comb base where the comb teeth are placed can be made of thermal conductive material.

In FIG. 2, the acoustic reflector is designed into a solid block. FIG. 2 shows a triangle shape. However, according to the practice demand, it can be other shapes. The body of the solid block is made of thermal conductive material.

In FIG. 3, the acoustic reflector is hollow and has at least one thermal conductive beam inside. On one hand, this design can reduce the weight of the acoustic reflector, on the other hand, this design gives a designer a design freedom to arrange the thermal paths in the heat sink/acoustic reflector.

FIGS. 4-7 shows embodiments of acoustic electronics device which incorporate the acoustic reflector as any of the above.

The acoustic electronics device is, for example, an electronics device like Apple Home pod, Amazon Mini Dot, Google Home and so on.

As shown, in FIGS. 4-7, the acoustic electronics device comprises an enclosure 1000; an acoustic transducer 2100, 2200, mounted inside the enclosure 1000; a passage 3000 inside the enclosure 1000; at least one sound port 5000, wherein the passage 3000 connects the acoustic transducer 2100, 2200 to the at least one sound port 5000; and an acoustic reflector 4000 as described above.

The acoustic reflector 4000 is mounted in the passage and reflects the sound wave from the acoustic transducer to the at least one sound port or from the at least one sound port to the acoustic transducer. As the sound wave travels, the air also flows. When the air passes the acoustic reflector 4000, it functions as a heat sink and the heat will be dispersed out of the at least one sound port 5000. The at least one sound port 5000 also functions as a vent. As such, the acoustic reflector 4000 with heat sink function can be deemed as a heat pump which abstracts heat from the acoustic transducer and pump the heat out through the sound port during it reflects sound wave. This heat dispersion path may be combined with the sound path.

This will save the room in the enclosure for placing a separate heat sink. Furthermore, the sound wave will help to improve the thermal dispersion effect.

The acoustic transducer may be a loudspeaker.

The acoustic transducer includes a front cavity 2200 and a back cavity 2100. The front cavity 2200 is surrounded by the back cavity 2100 and the passage 3000.

As shown, in FIGS. 4-7, the acoustic electronics device comprises a power unit 6000. The power unit 6000 provides power to the acoustic transducer. It may also include an amplification unit for the acoustic transducer.

Figure 5:
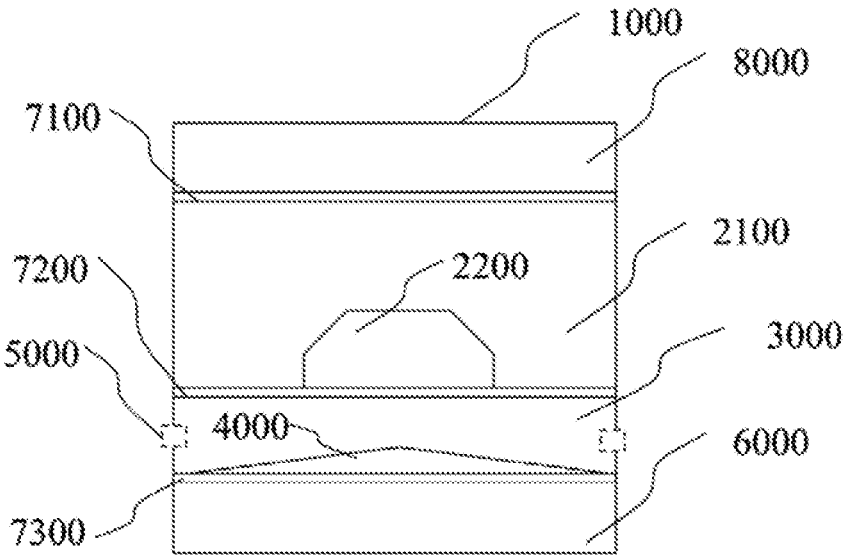
FIG. 5 is a schematic diagram of an acoustic electronics device according to a fifth embodiment of this disclosure.
Figure 6:
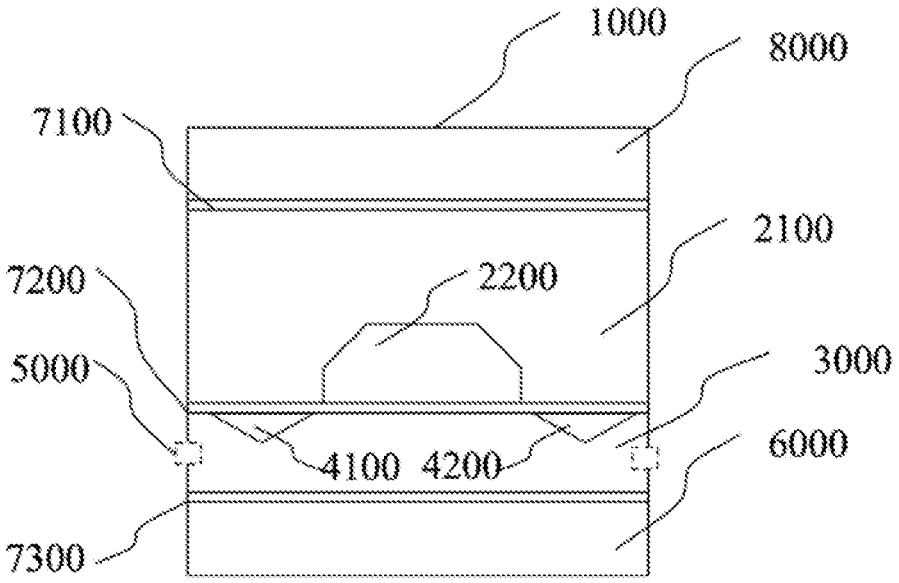
FIG. 6 is a schematic diagram of an acoustic electronics device according to a sixth embodiment of this disclosure.
Figure 7:
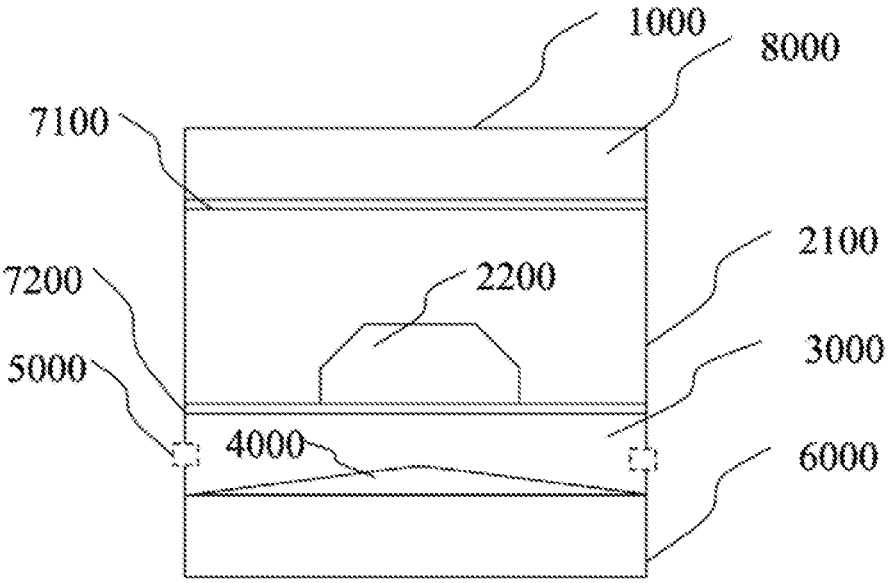
FIG. 7 is a schematic diagram of an acoustic electronics device according to a seventh embodiment of this disclosure.

As shown in FIGS. 5, 6 and 7, the acoustic transducer 2100, 2200 is mounted on a first side (upper side) of the passage 3000, the power unit 6000 is mounted on a second side (lower side) of the passage 3000, and the acoustic reflector 4000, 4100, 4200 is between the acoustic transducer 2100, 2200 and the power unit 6000.

Generally, a power unit is a major source of heat generation. Placement of the power unit adjacent to the passage will facilitate the dispersion of heat from the power unit.

In FIG. 6, the acoustic reflectors 4100, 4200 are mounted on the inner surface of the upper side of the passage 3000, which are on the same side with the acoustic transducer 2100, 2200.

In FIGS. 5 and 7, the power unit 6000 is mounted on an outer surface of the lower side of the passage 3000 and the acoustic reflector is mounted on an inner surface of the lower side of the passage.

Consequently, the heat sink is near the heat generation source and the thermal dispersion is more efficient.

As shown in FIG. 5, the power unit 6000 and the acoustic reflector 4000 sandwich a sealing plate 7300 inside the enclosure.

As shown in FIG. 7, the power unit 6000 is in direct contact with the acoustic reflector 4000. On one hand, this will omit a sealing plate and further improve the thermal dispersion performance; on the other hand, the power unit may be integrated with the acoustic reflector so as to simplify the assembly of the acoustic electronics device.

The acoustic electronics device may further comprise an operation unit 8000. The operation unit 8000 is used for operation of the acoustic electronics device and may include at least one of the following components: Bluetooth components, control button. WiFi components, microphone and light.

Figure 4:
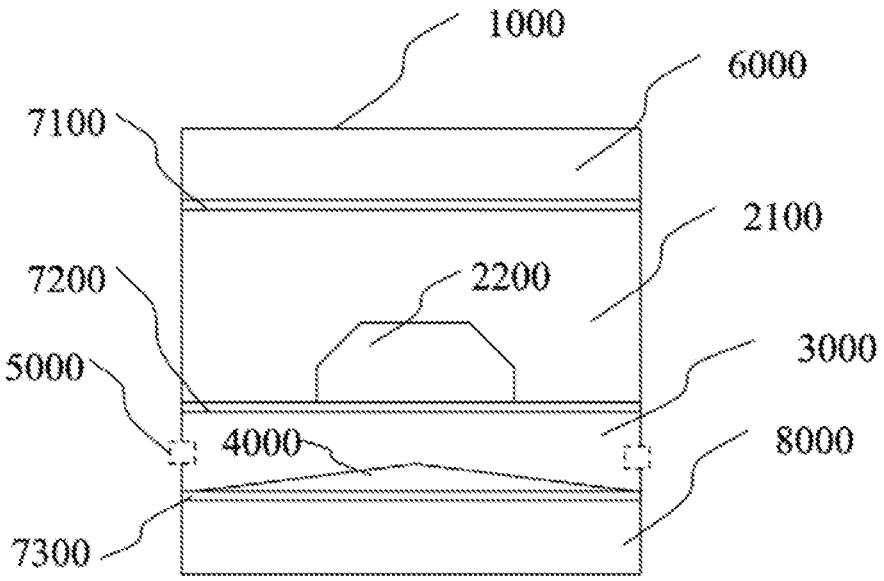
FIG. 4 is a schematic diagram of an acoustic electronics device according to a fourth embodiment of this disclosure.

As shown in FIG. 4, the acoustic transducer 2100, 2200 is mounted between the operation unit 8000 and the passage 3000.

FIG. 4 shows a different embodiment, in which the power unit 6000 is mounted above the acoustic transducer 2100, 2200.

As shown in FIGS. 4-7, the acoustic electronics device may further include sealing plates 7100, 7200 and 7300 for separating different components in the enclosure.

Although some specific embodiments of the present invention have been demonstrated in detail with examples, it should be understood by a person skilled in the art that the above examples are only intended to be illustrative but not to limit the scope of the present invention.

What is claimed is:

1. An acoustic electronics device, comprising:

an enclosure having a passage therein;

an acoustic transducer, mounted inside the enclosure, configured to generate a sound wave;

at least one sound port, wherein the passage connects the acoustic transducer to the at least one sound port;

an acoustic reflector for being used inside the enclosure of the acoustic electronics device, comprising a thermal conductive material to thereby provide a heat sink, wherein the acoustic reflector is formed in a comb shape comprising a comb body and comb teeth in cross-section view, with the comb teeth decreasing in height from the centre of the comb to the periphery thereof, and wherein the acoustic reflector is mounted in the passage and is configured to reflect the sound wave from the acoustic transducer to the at least one sound port and/or from the at least one sound port to the acoustic transducer; and a power unit, which provides power to the acoustic transducer, wherein the acoustic transducer is mounted on a first side of the passage, the power unit is mounted above the acoustic transducer, and the acoustic transducer is between the power unit and the acoustic reflector.

2. The acoustic electronics device according to claim 1, wherein the acoustic transducer is a loudspeaker.

3. The acoustic electronics device according to claim 1, wherein the acoustic reflector is mounted on an inner surface of a second side of the passage.

4. The acoustic electronics device according to claim 1, further comprising: an operation unit, which includes at least one of the following components: Bluetooth components, control button, WiFi components, microphone and light, wherein the acoustic transducer is mounted between the operation unit and the passage.

5. The acoustic electronics device according to claim 1, wherein the acoustic transducer includes a front cavity and a back cavity, and the front cavity is surrounded by the back cavity and the passage.

* * * * *